US010827843B2

(12) United States Patent
Miller

(10) Patent No.: US 10,827,843 B2
(45) Date of Patent: Nov. 10, 2020

(54) BODY SUPPORT PILLOW

(71) Applicant: Janine K. M. Miller, Escondido, CA (US)

(72) Inventor: Janine K. M. Miller, Escondido, CA (US)

( * ) Notice: Subject to any disclaimer, the term of this patent is extended or adjusted under 35 U.S.C. 154(b) by 200 days.

(21) Appl. No.: 16/121,314

(22) Filed: Sep. 4, 2018

(65) Prior Publication Data

US 2019/0069686 A1 Mar. 7, 2019

Related U.S. Application Data

(60) Provisional application No. 62/553,763, filed on Sep. 1, 2017.

(51) Int. Cl.

| | |
|---|---|
| ***A47C 20/02*** | (2006.01) |
| ***A47G 9/10*** | (2006.01) |
| ***A47C 20/00*** | (2006.01) |

(52) U.S. Cl.

CPC ..... *A47C 20/02* (2013.01); *A47C 20/021* (2013.01); *A47C 20/023* (2013.01); *A47C 20/025* (2013.01); *A47G 9/1036* (2013.01); *A47G 9/1045* (2013.01)

(58) Field of Classification Search

CPC ..... A47C 20/02; A47C 20/021; A47C 20/023; A47G 9/1036; A47G 9/1045

See application file for complete search history.

(56) References Cited

U.S. PATENT DOCUMENTS

| | | | | | |
|---|---|---|---|---|---|
| 395,043 | A | * | 12/1888 | Doremus | A47G 9/10 5/640 |
| 1,447,288 | A | * | 3/1923 | Emmerich | A47G 9/10 5/645 |
| 3,327,330 | A | * | 6/1967 | McCullough | A47G 9/10 5/640 |
| 4,173,048 | A | * | 11/1979 | Varaney | A47C 20/021 5/498 |
| 4,689,844 | A | * | 9/1987 | Alivizatos | A47C 27/086 297/452.16 |
| 4,901,384 | A | * | 2/1990 | Eary | A47C 20/021 5/632 |
| 5,066,001 | A | * | 11/1991 | Wilkinson | A63B 6/00 482/52 |

(Continued)

*Primary Examiner* — Robert G Santos
*Assistant Examiner* — Rahib T Zaman
(74) *Attorney, Agent, or Firm* — Perkins Coie LLP; Colin Fowler

(57) ABSTRACT

A body support pillow design having a top head pillow with a pillowcase that preferably includes a head pillow insert. The two bottom corners of connect to four total side pillows comprising two side arm pillows and two side leg pillows. Individual corners of the side pillows are attached by connecting joints with each body length side divided into two preferably even, separate parts extending longitudinally that can move with flexibility to be positioned for optimal comfort between the user's arms and legs when laying down in a left or right-side position.

The body support pillow may be assembled into a compact, attractive unit for easy storage, display and travel purposes. Thus, a considerably more versatile full body support pillow with a variety of functional uses is provided that can be used to deliver cooler sleeping conditions during warmer weather, and with users who sleep warmer year-round and during pregnancy.

15 Claims, 7 Drawing Sheets

(56) References Cited

U.S. PATENT DOCUMENTS 5,481,768 A * 1/1996 Shink ..... A47G 9/02 297/397
5,978,990 A * 11/1999 Akey ..... A47C 20/021 5/631
5,987,676 A * 11/1999 Littleford ..... A47G 9/10 5/636
6,052,848 A * 4/2000 Kelly ..... A47C 20/021 5/630
6,145,508 A * 11/2000 Seip, Jr. ..... A47C 20/021 128/845
6,412,127 B1 * 7/2002 Cuddy ..... A47C 20/026 5/632
6,691,352 B2 * 2/2004 Wang ..... A47G 9/10 5/636
6,874,183 B1 * 4/2005 Taylor ..... A47C 20/021 5/630
7,353,552 B2 * 4/2008 Leach ..... A47C 20/021 5/632
7,513,001 B1 * 4/2009 Leach ..... A47C 27/086 5/632
7,578,013 B2 * 8/2009 Aikman ..... A47C 20/021 5/632
D613,105 S * 4/2010 Chuang ..... D6/601
7,793,371 B1 * 9/2010 Leach ..... A47C 20/021 5/630
8,074,310 B1 * 12/2011 Robbins ..... A47C 20/025 5/632
D675,855 S * 2/2013 Reeves ..... D6/601
8,419,128 B1 * 4/2013 Leach ..... B60N 2/2881 297/219.12
8,973,191 B1 * 3/2015 Kvitek ..... A47G 9/10 5/640
9,021,635 B1 * 5/2015 Leach ..... A47C 20/02 5/630
9,226,565 B1 * 1/2016 Martin ..... A45F 4/06
9,629,487 B1 * 4/2017 Kvitek ..... A47G 9/10
2004/0226096 A1 * 11/2004 Davis ..... A47C 20/027 5/632
2008/0028529 A1 * 2/2008 Abell ..... A47G 9/0253 5/640
2016/0037946 A1 * 2/2016 Melcher ..... A47C 20/023 5/636

* cited by examiner

BODY SUPPORT PILLOW

CROSS-REFERENCE TO RELATED APPLICATION(S)

This application claims the benefit of U.S. Provisional Patent Application No. 62/553,763, filed Sep. 1, 2017, which is incorporated herein by reference in its entirety.

TECHNICAL FIELD

This disclosure relates generally to full body support pillows. This disclosure more particularly relates to an improved full body support pillow for use by women who are pregnant, as well as any person who may benefit from its multiple uses

BACKGROUND

Multi-purpose pillows aid women during and after a pregnancy with resting and sleeping, and with feeding their babies. Some of these pillows offer full body support, surrounding three sides of the user (head, left body side, right body side) to support four or more body parts. However, these full body support pillows can be bulky, heavy, and a hassle to deal with every night, especially when pregnant and attempting to get restful sleep. Other versions of these pillows only support one to three body parts (abdominal region and or arms and legs while laying down on one side). These pillows are smaller, lighter weight, and easier to maneuver, but do not come with the benefits of a pillow that includes full body support (head, neck, arms, abdominal area, hips, legs, and back). A pillow that provides full body support while remaining easily maneuverable is needed.

DETAILED DESCRIPTION

Disclosed herein is an improved full body support pillow system. The body support pillow system includes distinct head and side pillows coupled by flexible connecting joints. As used herein, a "pillow" can refer to either a pillow insert (i.e., a padded or filled component), a pillow cover adapted to encase a pillow insert, or to an assembled structure comprising multiple layers such as a pillow insert and a pillow cover. Where distinctions are relevant, they are noted; otherwise, the term "pillow" can refer to any one of or all three of these interpretations.

In one embodiment, a system of discrete pillows is chained together in a curved shape. The system comprises a head pillow having a first corner and a second corner. Two discrete first-tier pillows are individually connected to the first and second corner of the head pillow respectively, where a length of the first-tier pillows extends perpendicularly to a length of the head pillow. Two discrete second-tier pillows are each connected respectively to the first-tier pillows at an end of the first-tier pillows opposite of a connection between the first-tier pillows and the head pillow. A length of the second-tier pillows is arranged in parallel with the length of the first-tier pillows.

In another embodiment, a body pillow cover system comprises a chain of five pillow covers coupled together in a curved shape. A middle cover of the chain is positioned at an apex of the curved shape, and two pillow covers on each side of the middle cover extend perpendicularly from the middle cover. A connecting joint is coupled between two pillow covers in the chain.

In yet another embodiment, a body pillow system comprises a head pillow and a first pillow having a top left-side and a lower right-side. The first pillow is joined to the head pillow at the top left-side and joined to a second pillow at the lower right-side. The body pillow system also includes a third pillow having a top right side and a lower left side. The third pillow is joined to the head pillow at the top right side and joined to a fourth pillow at the lower left side. The first and third pillows extend perpendicularly from the head pillow, and are substantially parallel to one another.

Figure 1:
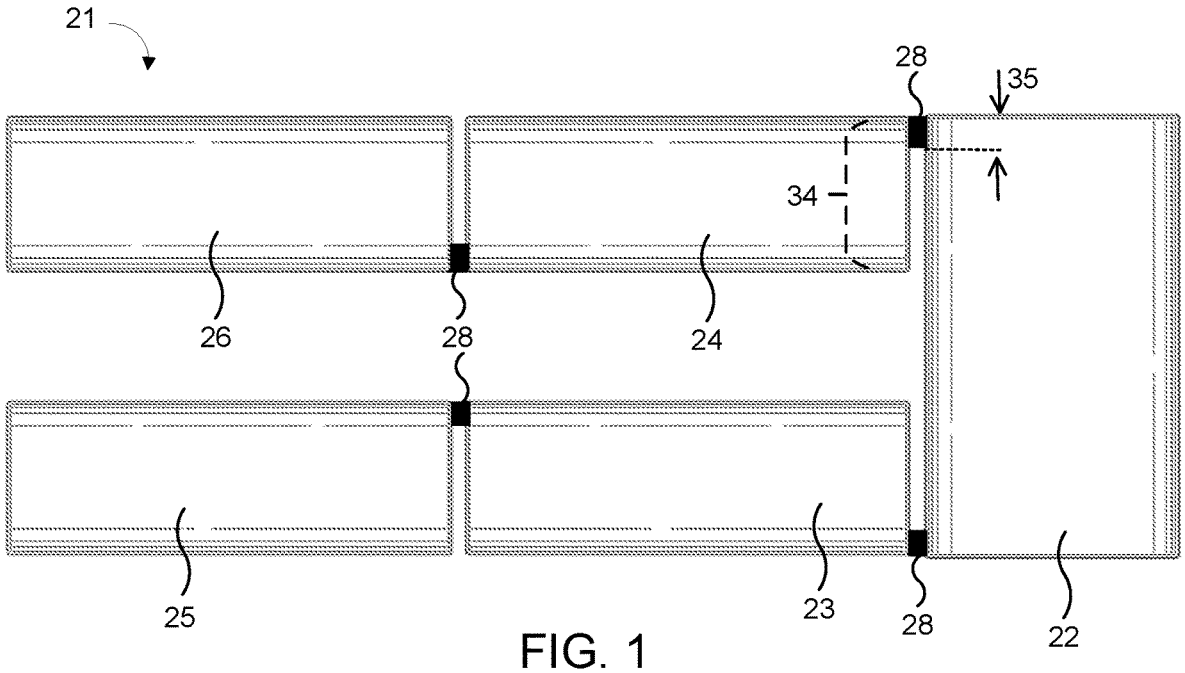
FIG. 1 is a top view of a body support pillow system, according to one embodiment.
Figure 2:
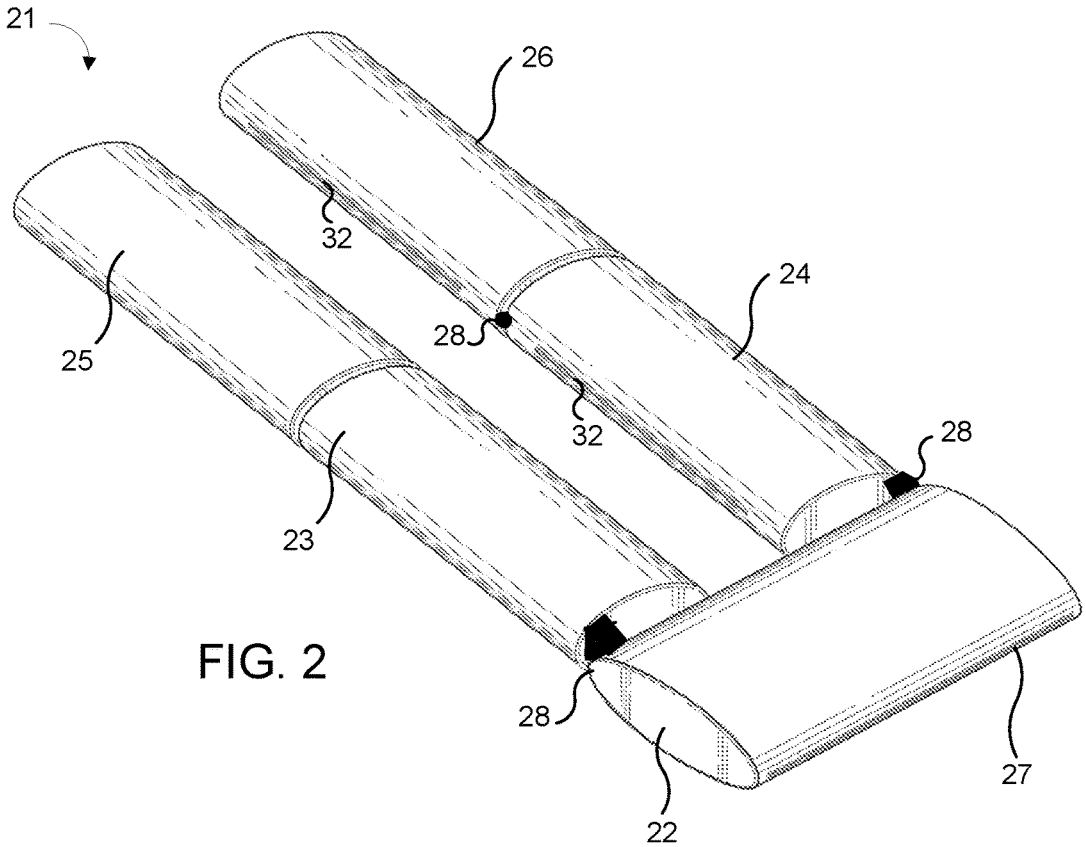
FIG. 2 is a perspective view of a body support pillow system.

Accordingly, several advantages of the disclosure are to provide an improved full body support pillow, to provide means of increasing the feeling of a cool body support pillow during warmer weather and pregnancy, and to provide a multi-purpose, user-friendly, high quality, yet economical body support pillow. Still further components and advantages will become apparent from a study of the following description and the accompanying drawings FIG. 1 is a top view of a body support pillow system 21 constructed in accordance with the disclosure. FIG. 2 is a perspective view of the pillows system 21. As shown in FIGS. 1 and 2, the body support pillow system 21 includes a head pillow 22, a left-side arm pillow 23, a right-side arm pillow 24, a left-side leg pillow 25, and a right-side leg pillow 26. The left-side arm pillow 23 and right-side arm pillow 24 are each a first-tier pillow, positioned adjacent to the head pillow 22. The left-side leg pillow 25 and right-side leg pillow 26 are each a second-tier pillow, positioned on an opposite side of the first-tier pillows from the head pillow 22. When the body support pillow system 21 is used by a user, the right-side arm pillow and right-side leg pillow 26 can be positioned towards a right-side of the user's body. The left-side arm pillow 23 and left-side leg pillow 25 can be positioned towards a left-side of the user's body.

The head pillow 22 has a right-side lower corner that is coupled by a connecting joint 28 to a top right corner of the right-side arm pillow 24 (i.e., a corner that is lateral to a user of the body support pillow system 21), and a left-side lower corner that is coupled by a connecting joint 28 to a top left (i.e., lateral) corner of the left-side arm pillow 23. The right-side arm pillow 24 has a lower left corner that is attached by a connecting joint 28 to a top left corner of the right-side leg pillow 26 (i.e., a corner that is medial to the user's body). The left-side arm pillow 23 has a lower right corner that is attached by a connecting joint 28 to a top right (i.e., medial) corner of the left-side leg pillow 25. The head pillow 22 may have a size selected from standard pillow sizes, such as a queen size or a king size, to enable a user to add a standard-sized pillow insert to the head pillow 22. However, in other cases, the head pillow 22 can be sized to accommodate a custom-sized pillow insert, or multiple standard-sized inserts.

One or more of the side pillows 23, 24, 25, 26 can have an opening 32. For example, FIG. 2 shows that both of the right-side pillows 24, 26 has a pillow opening 32 positioned on a medial side of the pillows. The openings 32 may be placed at other locations on the pillows, such as a bottom side, a lateral side, or top or bottom ends. The left-side pillows 23, 25 may have similar openings. Each pillow opening 32 allows the user to add or remove a pillow insert to the side pillows 23, 24, 25, 26, for example so that a pillow cover can be washed separately from the pillow inserts. The openings 32 can each have a closure mechanism, such as a zipper, an envelope closure, a snap, a hook and eye, a magnetic closure, or Velcro.

The body support pillow system 21 can be sized to approximately fit a user. In some embodiments, a total length of the body support pillow system 21 from a top of the head pillow 22 to a bottom of each leg pillow 25, 26 can be between approximately four feet and approximately seven feet. For example, each side pillow 23, 24, 25, 26 can be between 20 and 40 inches long, or more specifically between 25 and 30 inches long. In some embodiments, each side pillow 23, 24, 25, 26 is approximately the same length. In other embodiments, the arm pillows 23, 24 are both approximately a first length, while the leg pillows 25, 26 are both approximately a second length that is different from the first length. In still another embodiment, the left-side pillows 23, 25 are both approximately a first length, while the right-side pillows 24, 26 are both approximately a second length that is different from the first length. Each side pillows 23, 24, 25, 26 may instead be a different length.

The connecting joints 28 provide flexibility in pillow support and a comfortable design for a user. Four connecting joints 28 are visible in the figure. The side pillows 23, 24, 25, 26 are rotatable around the connecting joints 28 to adjust to the comfort needs of a user. In one embodiment, the left- and right-side arm pillows 23, 24 are rotatable outward around the connecting joints 28 (i.e., laterally away from the user), and the left and right-side leg pillows 25, 26 are rotatable inward around the connecting joints 28 (i.e., medially toward the user). For example, a pregnant user can rotate the arm pillows 23, 24 outward to provide room and well-designed comfort for her growing belly during any stage of pregnancy, while rotating the leg pillows 25, 26 inward to comfortably fit between the legs of the user. As another example, a user who wishes to use the pillow system 21 for support in a seated position can move the arm pillows 23, 24 outward to accommodate a width of the user's hips. The leg pillows 25, 26 can be rotated inward to support the user's legs, or can be folded over the arm pillows 23, 24 to provide arm support. The arm pillows 23, 24 can, in still another use case, rotate outward to allow two or more people to use the pillow system 21 together.

The connecting joints 28 can comprise any flexible or elastic material, such as fabric, rope, or elastic cord, that is fastened between respective pillows in the pillow system 21. To enable relative rotation of the pillows around the connecting joints 28, a length of a connection between each connecting joint 28 and a pillow 22, 23, 24, 25, 26 may be less than a third of the width of the pillow. For example, as shown in FIG. 1, the right arm side pillow 24 has a width 34 while the connecting joint 28 between the head pillow 22 and side pillow 24 has a length 35. The length 35 is less than approximately one third of the width 34.

Figure 3:
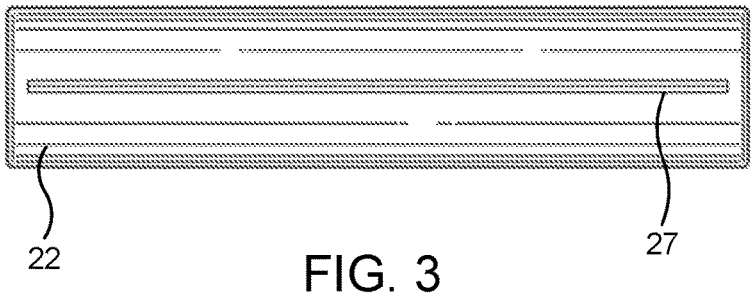
FIG. 3 is a back view of the body support pillow.

FIG. 2 also shows that the head pillow 22 has a zipper 27. FIG. 3 is a back view of the body support pillow 21, showing the zipper 27. The zipper 27 provides access to an interior of the head pillow 22, enabling a user to add or remove a pillow insert (not shown). One or more sides of the head pillow 22 other than the zipper 27 can be sealed (e.g., sewn closed). The zipper 27 can be zipped closed to encase the pillow insert in a pillow lining, or zipped open for the pillow insert to be inserted or removed. The head pillow 22 may have other closure mechanisms instead of or in addition to the zipper 27, such as an envelope closure, a snap, a hook and eye, a magnetic closure, or Velcro. Alternatively, the head pillow 22 may have an opening without a closure mechanism.

Figure 4:
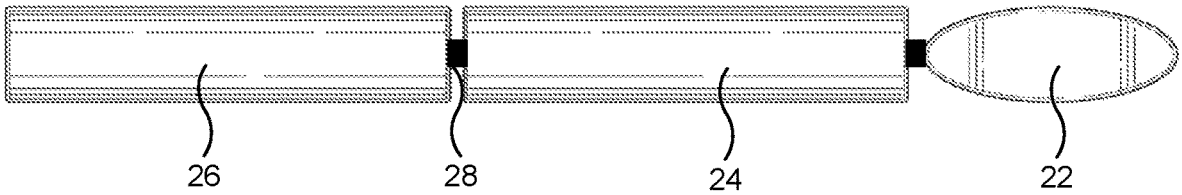
FIG. 4 is a right-side view of the body support pillow.

FIG. 4 is a right-side view of the body support pillow system 21, showing the connecting joints 28 that join the head pillow 22 to the right-side arm pillow 24 and join the right-side arm pillow 24 to the right-side leg pillow 26. In one embodiment, each arm and leg side pillow includes a pillow cover and a pillow insert (not shown) that can be placed into or removed from the pillow cover via the openings 32 shown in FIG. 2. For example, the pillow inserts can be removed for easy washing of the pillow cover. In other embodiments, the pillow inserts are not removable from the pillow covers. The left-side arm pillow 23 and left-side leg pillow 26 may be structured similarly to the right-side pillows 24, 26 shown in FIG. 4.

Figure 5:
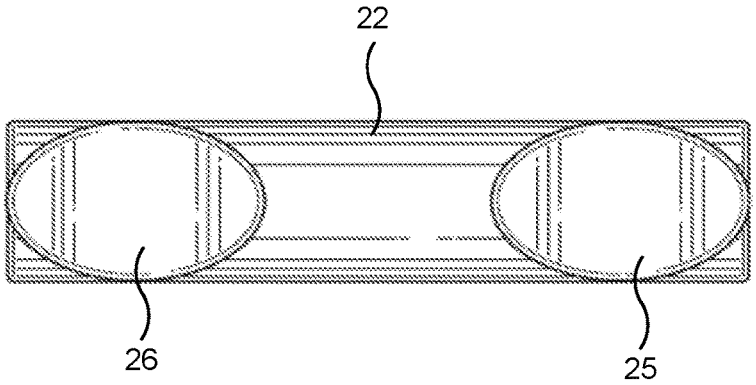
FIG. 5 is a front-side view of the body support pillow.

FIG. 5 is a front-side view of the body support pillow system 21. As shown in FIG. 5, a cross-section of the side pillows 23, 24, 25, 26 can be substantially round, such as circular or elliptical. The side pillows 23, 24, 25, 26 may have other cross-sectional shapes in other embodiments, such as rectangular, triangular, or pentagonal.

Figure 6A:
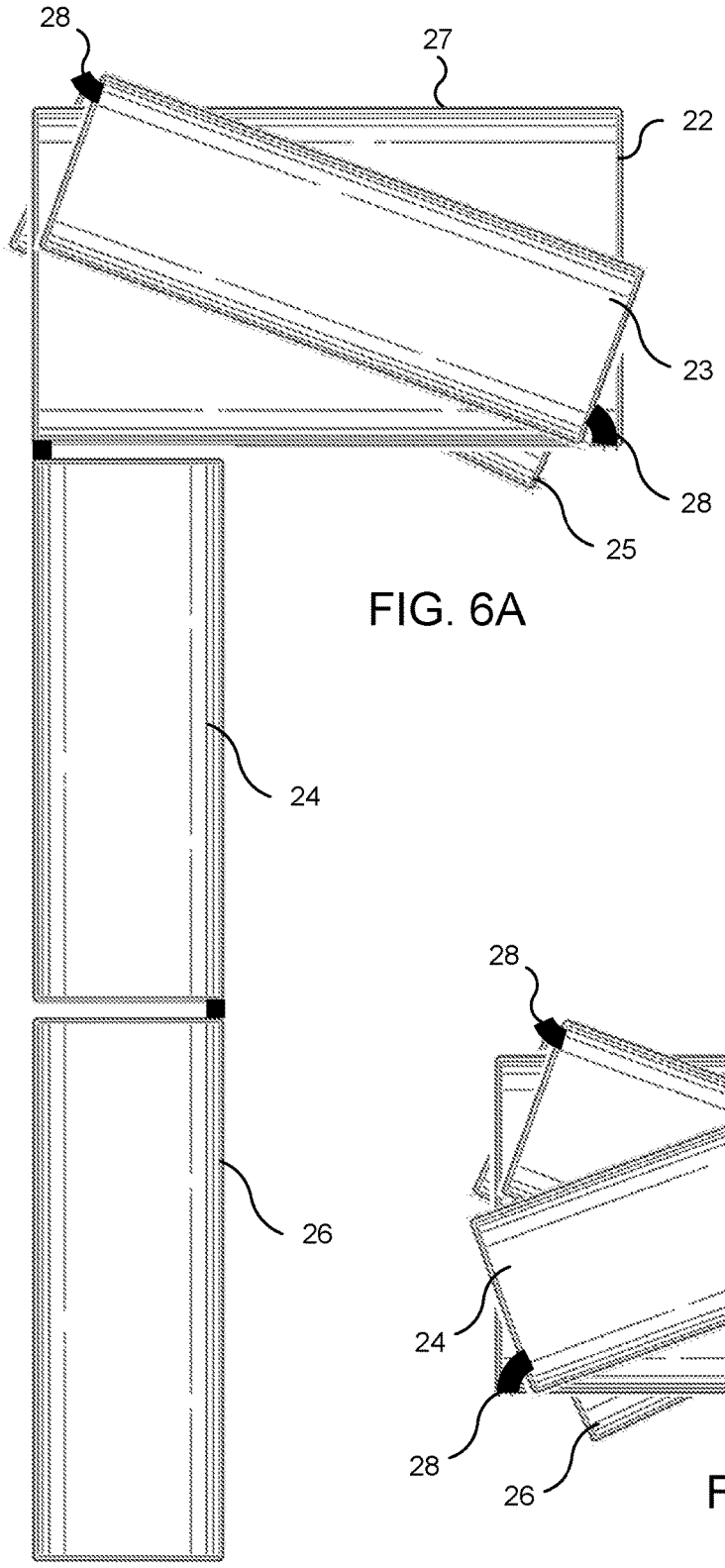
FIG. 6A-6B are front views of the body support pillow when folded.
Figure 6B:
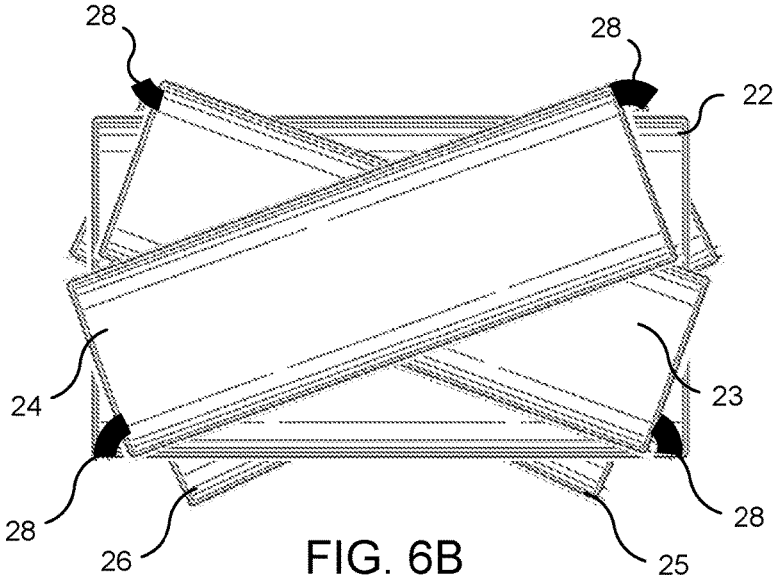

The body support pillow system 21 can be folded into a smaller configuration for storage. FIGS. 6A-6B illustrate how the pillow system 21 can be folded into a "stowed" configuration. As shown in FIG. 6A, the head pillow 22 can stand upright with the zipper 27 on top while the left-side arm pillow 23 is folded up from its connecting joint 28 diagonally across to an upper right-side corner of the head pillow 22, where the next connecting joint 28 allows the left-side leg pillow 25 to fold over the head pillow 22 diagonally down so that the bottom of the left-side leg pillow 25 falls against the bottom of the lower left corner of the head pillow 22 from a back view. FIG. 6B shows that the right-side arm pillow 24 can similarly fold up at the connecting joint 28 in a diagonal crossover from the right bottom corner of the head pillow 22 over to a top left-side corner of the head pillow 22. The right-side leg pillow 26 folds over the head pillow 22 at the connecting joint 28, and crosses diagonally over the back side of the head pillow 22. Although FIG. 6B shows the right-side arm pillow 24 folding across the front side of the head pillow 22, the right-side arm pillow 24 may instead fold across the back side of the head pillow 22 (i.e., on an opposite side of the head pillow 22 from the left-side arm pillow 23). When folded across the head pillow 22, the right-side leg pillow 26 can either rest under or above the already positioned left-side leg pillow 25.

The right-side leg pillow 26 can be attachable by Velcro, snaps, clipping mechanism, hooks, or other attachment mechanism known in the art to another portion of the body support pillow system 21, such as the left-side leg pillow 25, the head pillow 22, or the right-side arm pillow 24, in order to ensure that the body support pillow system 21 remains folded. Furthermore, portions of the support pillow system 21 may be sized to accommodate such folding. For example, the leg pillows 25, 26 may be longer than the arm pillows 23, 24 to enable the leg pillows 25, 26 to fold over the arm pillows 23, 24. The connecting joints 28 between the arm and leg pillows may additionally or alternatively be longer than the connecting joints 28 between the head pillow 22 and arm pillows 23, 24. The final folded configuration of the support pillow system 21 is more compact than the unfolded, open configuration, allowing the support pillow system 21 to be more conveniently stored or more neatly displayed.

Figure 7:
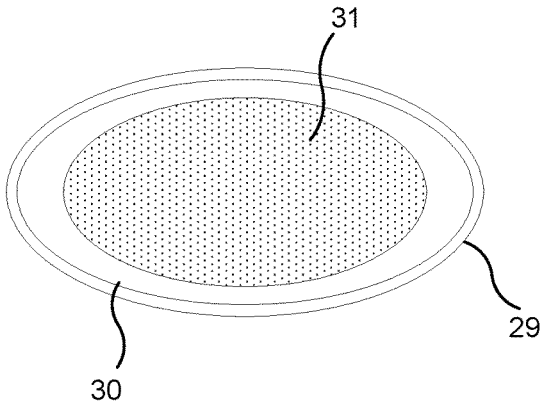
FIG. 7 is a cross section showing layers of the body support pillow.

FIG. 7 is a cross section showing layers of the body support pillow 21. Some or all of the head pillow 22, left-side arm pillow 23, right-side arm pillow 24, left-side leg pillow 25, and right-side leg pillow 26 may have the cross section shown in FIG. 7. As shown, one embodiment of the support pillow 21 can include a pillow cover 29, a pillow lining 30, and a pillow insert 31. The pillow cover 29 forms a cavity into which the pillow insert 31 can be inserted. The pillow insert 31 is enclosed by the pillow cover 29 when inside the cavity, and may be removable from within the interior of the pillow cover 29. The pillow lining 30 can be positioned between the pillow cover 29 and pillow insert 31 when the pillow insert 31 is enclosed in the cover 29. For example, the pillow lining 30 can be coupled to an interior surface of the pillow cover or to an exterior surface of the pillows insert 31.

The pillow insert 31 can comprise any material having natural latex properties, such as talalay latex, copper infused talalay latex, or talalay latex down fill. The pillow cover 29 can comprise a material having soft, natural, and environmentally sustainable properties, such as lyocell Tencel, polyester, organic cotton, bamboo, or any combination of these materials. The pillow lining 30 can comprise a material having cooling features, such as polyester, polyester and latex, organic cotton, bamboo, a cooling gel, or polyester or cotton with additional cooling technology materials.

In some cases, the pillow lining 30 comprises a material with a higher thermal conductivity than other layers of the pillow, enabling the pillow lining 30 to spread heat more evenly across the pillow. The thermally conductive portion of the pillow lining 30 may be positioned across substantially an entire inner surface of the pillow cover 29. Alternatively, the thermally conductive portion can cover portions of the inner surface of the pillow cover 29, such as portions that are more likely to come into contact with warm areas of a user. For example, a top portion of each pillow 22, 23, 24, 25, 26 may be lined with the thermally conductive lining 30 to distribute heat away from a user lying on top of the pillow system 21, while a bottom portion of the pillows is not lined with the thermally conductive lining 30. In another example, portions of the head pillow 22 and arm pillows 23, 24 can be lined with the thermally conductive lining 30, while the leg pillows 25, 26 are not.

In other embodiments, layers additional to or instead of the lining 30 can include thermal regulation features. For example, the pillow insert 31 may include thermally conductive materials, moisture wicking materials, or materials that allow air flow such as an open foam, to provide thermal comfort to a user. The pillow cover 29 may include moisture-wicking materials to wick sweat and condensation away from a user's body to help cool the user. Similar to the lining 30, the pillow cover 29 may include thermally conductive portions covering some or all of the cover 29 to conduct heat away from the user's body.

Figure 8:
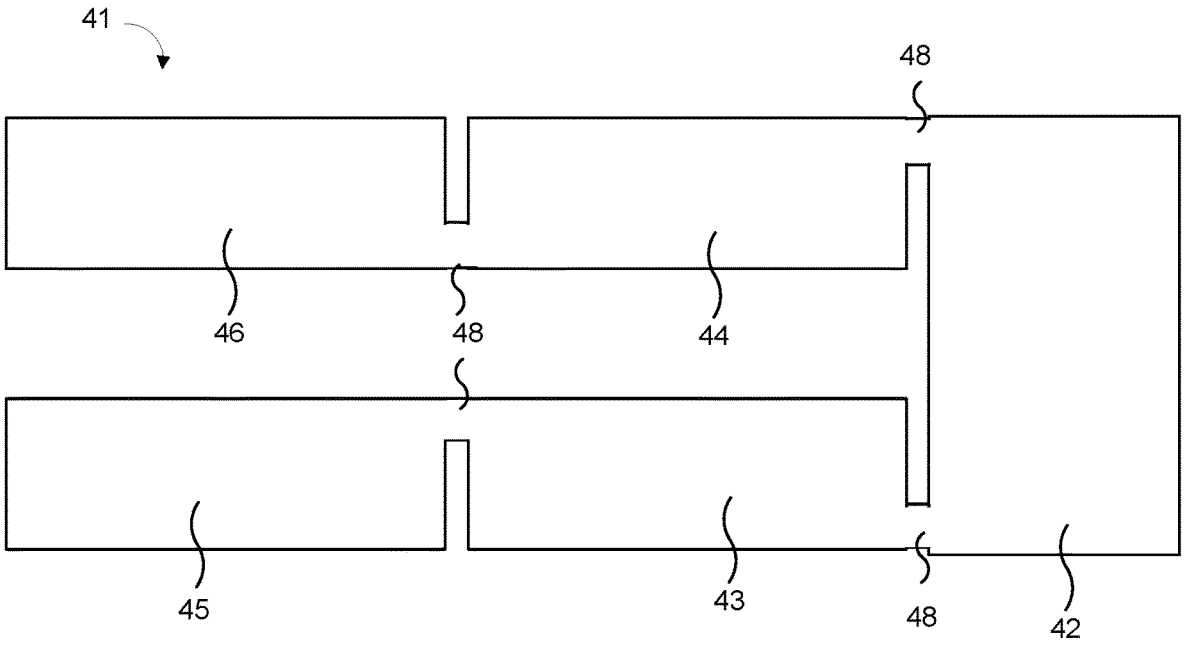
FIG. 8 is a top view of a pillow cover.
Figure 9:
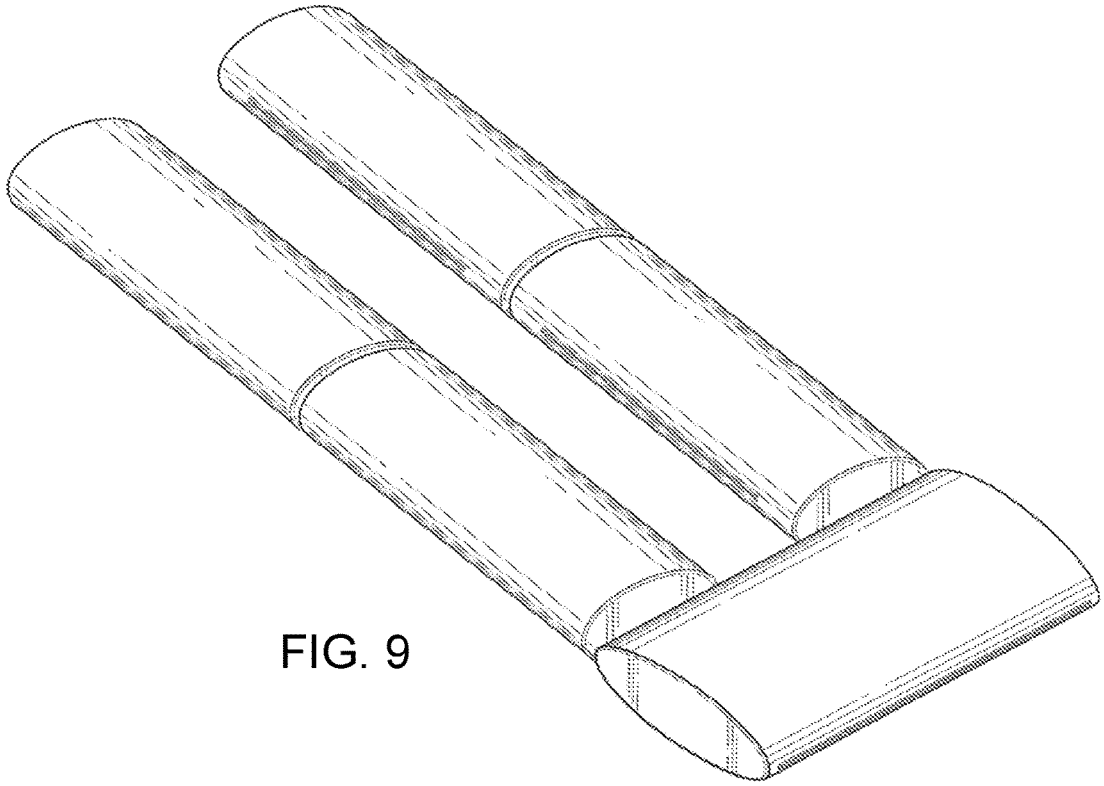
FIG. 9 is a left-side perspective view of a body support pillow system.
Figure 10:
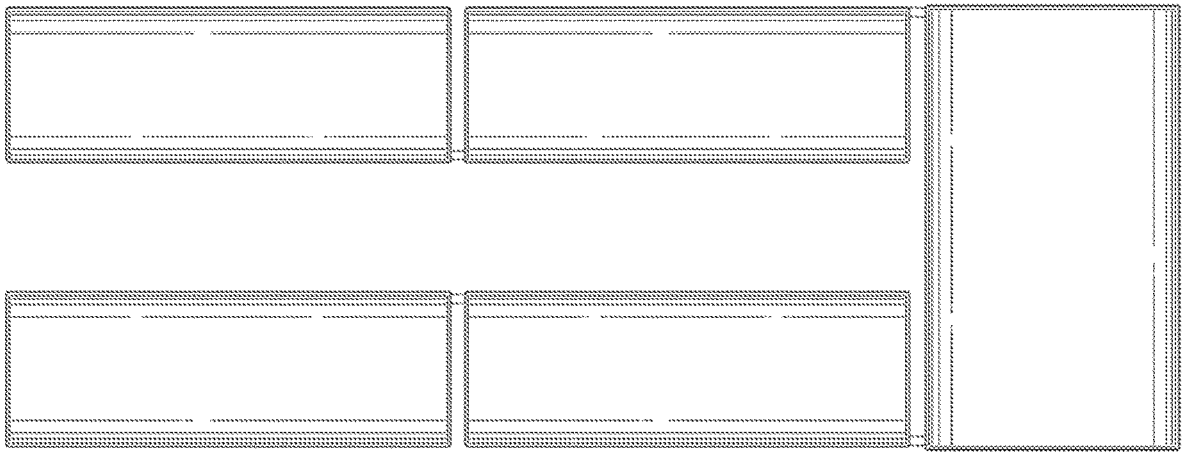
FIG. 10 is a top view of the body support pillow system.
Figure 11:
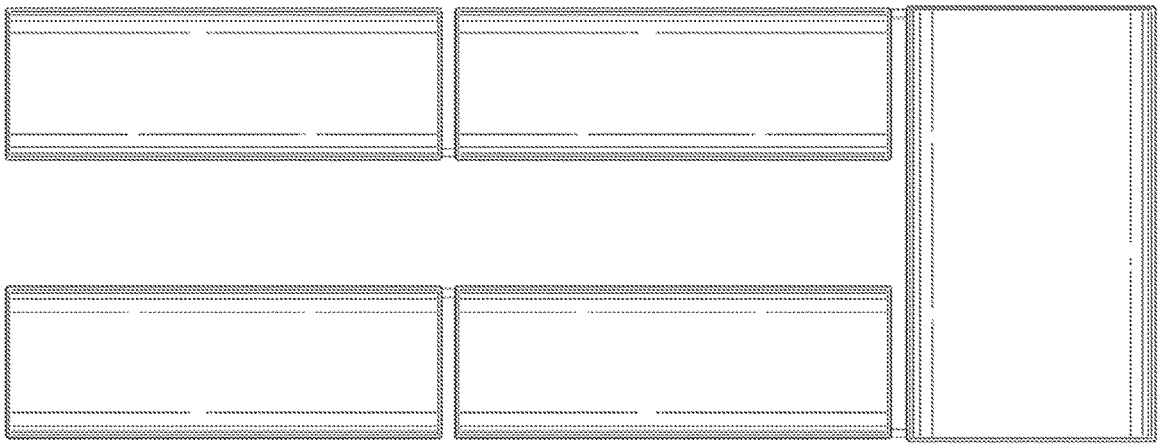
FIG. 11 is a bottom view of the body support pillow system.
Figure 12:
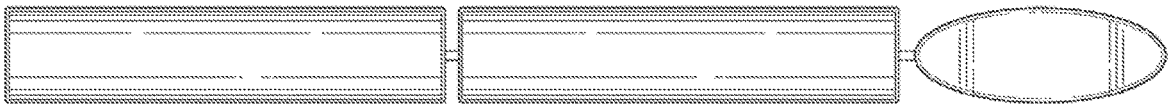
FIG. 12 is a left view of the body support pillow system.
Figure 13:
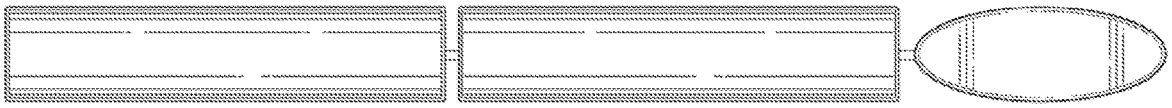
FIG. 13 is a right view of the body support pillow system.
Figure 14:
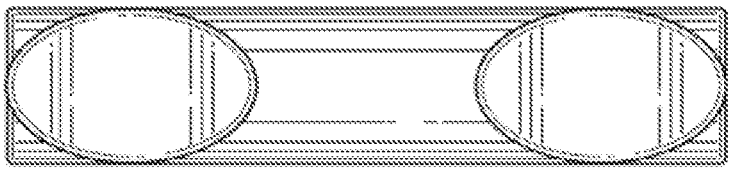
FIG. 14 is a front view of the body support pillow system.
Figure 15:
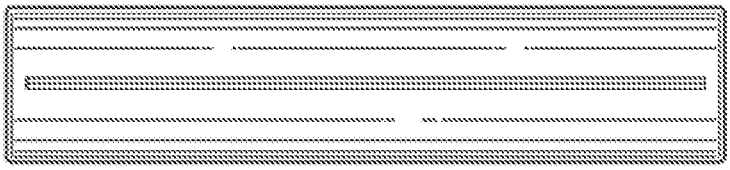
FIG. 15 is a back view of the body support pillow system.

FIG. 8 is a perspective right-side view of a pillow cover 29 of the body support pillow 21. As shown in FIG. 8, the pillow cover 29 includes a head pillow cover 42, a left arm side pillow cover 43, a right-side arm pillow cover 44, a left-side leg pillow cover 45, and a right-side leg pillow cover 46. The head pillow cover 42 has a right-side lower corner that is coupled by a connecting join 48 to a top right corner of the right-side arm pillow cover 44 (i.e., a corner that is lateral to a user of the body support pillow 21), and a left-side lower corner that is coupled by a connecting joint 48 to a top left (i.e., lateral) corner of the left-side arm pillow cover 43. The right-side arm pillow cover 44 has a lower left corner that is attached by a connecting joint 48 to a top left corner of the right-side leg pillow cover 46 (i.e., a corner that is medial to the user's body). The left-side arm pillow cover 43 has a lower right corner that is attached by a connecting joint 48 to a top right (i.e., medial) corner of the left-side leg pillow cover 45. One or more of the side pillow covers 43, 44, 45, 46 can have a pillow opening to allow the user to place a pillow insert inside of the pillow cover 29 or to remove the pillow inserts from the cover 29.

While prior full body support pillows offer some flexibility in their construction, each respectively has comparatively limited flexibility as they do not have the five-pillow, lightweight, easily maneuvered construction as disclosed herein. Furthermore, this body pillow disclosed herein enables for removability of the included pillow inserts and lining should the user wish to modify size, fill density, or other aspects of the pillow inserts.

In operation, one uses the full body support pillow in a manner consistent use of other body pillows. In some cases, the primary positioning of use may be side-laying. For example, a pregnant user can use the pillow to comfortably sleep on her left-side (considered the safest method of sleep during pregnancy). Users, pregnant or not pregnant alike, may sleep on their back or left or right-sides. The pillow can be manipulated to turn into a nursing pillow post pregnancy, into a seated position when relaxing and used for reclining or lounging against something (e.g., couch, bed headboard, wall, etc.) with the back elevated.

The body support pillow 21 is foldable for convenience and comfort of the user. Because the pillow 21 can be folded in different ways, a user has multiple options for pillow usage. For example, a user can only use upper parts of the pillow for the arms, without having to use the bottom part for the legs. In this configuration, the user may fold leg side pillows up next to arm side pillows for extra comfort and additional arm support. In another configuration, a user can fold the leg pillows together to elevate legs and feet. Still another configuration allows the user to use the full body support pillow post-pregnancy to aid in nursing/feeding their baby. The full body support pillow 21 can be maneuvered so that the head pillow is resting on the user's legs while in the seated position and the arm and leg side pillows are folded together on both left and right-sides of the user for added user arm support during nursing/feeding session for the baby. The pillow 21 can also be folded to a compact configuration that can be used as a travel pillow, can be easily carried, and can be nicely displayed when not in use.

From the foregoing, it will be appreciated that specific embodiments of the invention have been described herein for purposes of illustration, but that various modifications may be made without deviating from the scope of the invention. Accordingly, the invention is not limited except as by the appended claims.

The invention claimed is:

1. A system of discrete pillows chained together in a curved shape, comprising:

a head pillow having a first corner and a second corner;

two discrete first-tier pillows individually connected to the first and second corner of the head pillow respectively via a first set of joints, a length of the first-tier pillows arranged perpendicularly to a length of the head pillow; and two discrete second-tier pillows each connected respectively via a second set of joints to the first-tier pillows, wherein the second set of joints are positioned at an end of the first-tier pillows diagonal to the first set of joints between the first-tier pillows and the head pillow, a length of the second-tier pillows arranged in parallel with the length of the first-tier pillows.

2. The system of claim 1, wherein the first set of joints between the first-tier pillows and the head pillow is between the first and second corners of the head pillow and respective outer corners of the first-tier pillows, wherein the respective outer corners of the first-tier pillows are positioned in a mirror image configuration of each other.

3. The system of claim 1, wherein the first-tier pillows are rotatable around the head pillow via the first set of joints.

4. The system of claim 1, wherein the first set of joints between the first-tier pillows and the head pillow is less than one third a width of the first arm pillow.

5. The system of claim 1, wherein the second set of joints between the first-tier pillows and the second-tier pillows is between respective inner corners of the first-tier pillows and inner corners of the second-tier pillows, wherein the respective inner corners of the first-tier pillows and the second-tier pillows are positioned in a mirror image configuration of each other.

6. The system of claim 5, wherein the second-tier pillows are rotatable around the first-tier pillows via the second set of joints.

7. The system of claim 1, wherein any of the head pillow, the first-tier pillows, or the second-tier pillows further comprises:

a pillow cover and a pillow lining, wherein the pillow lining has a thermal conductivity that is higher than a thermal conductivity of the pillow cover.

8. The system of claim 1, wherein a cross-section of any of the head pillow, the first-tier pillows, or the second-tier pillows is elliptical.

9. A body pillow cover system, comprising:

a chain of five discrete pillow covers coupled together in a curved shape, a middle cover of the chain positioned at an apex of the curved shape and two pillow covers on each side of the middle cover extending perpendicularly from the middle cover; and a plurality of connecting joints positioned between the chain of five pillow covers, wherein each pillow cover is rotatable around an adjacent pillow cover via a respective joint between the pillow covers, the plurality of joints including:

a first joint positioned between a bottom left corner of the middle cover and a top left corner of a first pillow cover adjacent to the middle cover;

a second joint positioned at a bottom right corner of the first pillow cover situated diagonally to the first joint and the second joint at a top right corner of a second pillow cover adjacent to the first pillow cover in the chain;

a third joint positioned between a bottom right corner of the middle cover and a top right corner of a third pillow cover adjacent to the middle cover; and a fourth joint positioned at a bottom left corner of the third pillow cover situated diagonally to the third joint and the fourth joint at a top left corner of a fourth pillow cover adjacent to the third pillow cover in the chain.

10. The body pillow cover system of claim 9, wherein each of the five pillow covers is configured to at least partially encase a pillow insert, and wherein the middle cover is configured to at least partially encase a head pillow insert.

11. The body pillow cover system of claim 9, wherein at least one of the five pillow covers comprises a pillow lining coupled to an interior of the pillow cover, wherein the pillow lining has a thermal conductivity that is higher than a thermal conductivity of the pillow cover.

12. A body pillow system, comprising:

a head pillow;

a first pillow extending perpendicularly from the head pillow and having a top left side and a lower right side, the first pillow joined to the head pillow at the top left side via a first joint and joined to a second pillow at the lower right side via a second joint positioned diagonally to the first joint, a length of the second pillow parallel to a length of the first pillow, wherein the first pillow is rotatable around the head pillow via the first joint and the second pillow is rotatable around the first pillow via the second joint; and a third pillow extending perpendicularly from the head pillow and having a top right side and a lower left side via a third joint, the third pillow joined to the head pillow at the top right side and joined to a fourth pillow at the lower left side via a fourth joint, a length of the fourth pillow parallel to a length of the third pillow, wherein the third pillow is rotatable around the head pillow via the third joint and the fourth pillow is rotatable around the third pillow via the fourth joint.

13. The body pillow system of claim 12, wherein the first pillow is rotatable via the first joint across a top side of the head pillow, the second pillow is rotatable via the second joint across a back side of the head pillow, the third pillow is rotatable via the third joint across the back side of the head pillow and the second pillow, and the fourth pillow is rotatable via the fourth joint across the front side of the head pillow and the first pillow, and wherein the fourth pillow is attachable to the head pillow to secure the body pillow system in a stowed configuration.

14. The body pillow of claim 12, wherein the head pillow and first arm pillow each comprise a pillow cover and a pillow lining, wherein the pillow lining has a thermal conductivity that is higher than a thermal conductivity of the pillow cover.

15. The body pillow of claim 12, wherein a cross-section of the first pillow is elliptical.

* * * * *